United States Patent [19]

Witzel

[11] Patent Number: 4,601,280

[45] Date of Patent: Jul. 22, 1986

[54] FIREPLACE INSERT

[75] Inventor: Ted Witzel, Kitchener, Canada

[73] Assignee: Onward Hardware Limited, Kitchener, Canada

[21] Appl. No.: 619,202

[22] Filed: Jun. 11, 1984

[51] Int. Cl.[4] ..... F24B 7/00

[52] U.S. Cl. ..... 126/121

[58] Field of Search ..... 126/121, 126, 131, 143, 126/112, 77, 285 A, 288; 237/51

[56] References Cited

U.S. PATENT DOCUMENTS

| | | | |
|---|---|---|---|
| 2,297,776 | 10/1942 | Kelley et al. . | |
| 2,642,859 | 6/1953 | Brown . | |
| 4,059,090 | 11/1977 | Shaw . | |
| 4,169,458 | 10/1979 | Shaw . | |
| 4,170,219 | 10/1979 | Hansen et al. | 126/121 |
| 4,185,610 | 1/1980 | Buckner . | |
| 4,224,921 | 9/1980 | Petrescue | 126/121 |
| 4,254,756 | 3/1981 | Wells . | |
| 4,271,815 | 6/1981 | Johnson | 126/121 |
| 4,280,473 | 7/1981 | Hempel . | |
| 4,404,954 | 9/1983 | Steel | 126/121 |
| 4,434,783 | 3/1984 | O'Gorman | 126/121 |
| 4,471,755 | 9/1984 | Faehling et al. | 126/121 |
| 4,475,531 | 10/1984 | Gerhart | 126/121 |

FOREIGN PATENT DOCUMENTS

| | | |
|---|---|---|
| 500427 | 3/1954 | Canada . |
| 1061207 | 8/1979 | Canada . |
| 1094902 | 2/1981 | Canada . |
| 1139624 | 1/1983 | Canada . |

*Primary Examiner*—Randall L. Green

*Attorney, Agent, or Firm*—Sixbey, Friedman & Leedom

[57] ABSTRACT

An improved double walled prefabricated fireplace apparatus insertable into a pre-existing masonry fireplace in a building for heating a room. The apparatus is provided with an air manifold within the apparatus adjacent the combustion chamber and having opposite mutually spaced walls through one of which an inlet for room air is provided and through the other of which an inlet for fresh outside air is provided. The manifold is further provided with an outlet for enabling air to flow to the air heating chamber between the double walls. A manually adjustable air flow control means is provided slidable within the manifold between two positions, one blocking the flow of air through the room air inlet and leaving open the fresh air inlet, and the other blocking the flow of air through the fresh air inlet and leaving open the room air inlet. The air flow control means is of a size and construction to permit, when air enters the manifold through either of the inlets, that air to flow to the air outlet to the air heating chamber. The manifold is preferably also provided with an outlet which communicates with the combustion chamber, which outlet manually adjustable independently from the air flow control means for the manifold air inlets, when open permitting flow of air from the manifold to the combustion chamber and when closed preventing such flow. This apparatus permits controlled direction of cold room air or fresh outside air to its air heating chamber and then to the room, and/or controlled direction of such air to the combustion chamber.

19 Claims, 9 Drawing Figures

FIREPLACE INSERT

The present invention relates to a prefabricated fireplace apparatus insertable into a pre-existing masonry fireplace in a building for heating a room, and more particularly to a zero clearance, double walled fireplace having improved air flow characteristics.

BACKGROUND OF THE INVENTION

Double or multiple walled fireplaces and fireplace inserts, in which air is heated between the walls prior to delivery to the room to be heated, are known in the art. For example, Kelley et al U.S. Pat. No. 2,297,776 issued Oct. 6, 1942; Austin U.S. Pat. No. 2,362,526 issued Nov. 14, 1944; Brown U.S. Pat. No. 2,642,859 issued June 23, 1953; Fogel et al U.S. Pat. No. 2,703,566 issued Mar. 8, 1955; Andrews U.S. Pat. No. 3,762,391 issued Oct. 2, 1973; Nelson U.S. Pat. No. 3,965,886 issued June 29, 1976; Nelson U.S. Pat. No. 3,995,611 issued Dec. 7, 1976; Buckner U.S. Pat. No. 4,185,610 issued Jan. 29,1980; Martenson U.S. Pat. No. 4,015,581 issued Apr. 5, 1977; Shaw U.S. Pat. No. 4,059,090 issued Nov. 22, 1977; Jensen U.S. Pat. No. 4,074,679 issued Feb. 21, 1978; Shaw U.S. Pat. No. 4,169,458 issued Oct. 2, 1979 (Canadian Patent No. 1,061,207 issued Aug. 28, 1979); Buckner U.S. Pat. No. 4,185,610 issued Jan. 29, 1980; Wells U.S. Pat. No. 4,254,756 issued Mar. 10, 1981; Hempel U.S. Pat. No. 4,280,473 issued July 28, 1981; Brown Canadian Patent No. 500,427 issued Mar. 2, 1954; Petrescue Canadian Patent No. 1,094,902 issued Feb. 3, 1981; Buckner et al Canadian Patent No. 1,139,624 issued Jan. 18, 1983 all describe various constructions of such double or multiple walled fireplaces. In most of these constructions, convection or fan assisted circulation of room or outside air through the double walls is provided, the air being heated while between the double walls as it passes over the surface of the combustion chamber wall. In certain of these constructions, such as Shaw U.S. Pat. No. 4,059,090, Jensen U.S. Pat. No. 4,074,679, Shaw U.S. Pat. No. 4,169,458 and Wells U.S. Pat. No. 4,254,756, as well as Petrescue Canadian Pat. No. 1,094,902, there is limited control of the flow of alternatively fresh air from outside, or room air, through the double walls and/or the combustion chamber.

Of general background interest are additionally Brooks U.S. Pat. No. 2,359,197 issued Sept. 26, 1944; Bauer U.S. Pat. No. 3,190,282 issued June 22, 1965; and Kamstra et al U.S. Pat. No. 4,143,638 issued Mar. 13, 1979.

It is an object of the present invention to provide an improved and novel construction for controlling the flow of room air and outside air through the air heating chamber between the walls of a double wall fireplace. It is a further object of the present invention to provide a construction for such a fireplace which will, as required, divert flow of some of that air to the combustion chamber.

SUMMARY OF THE INVENTION

According to the present invention there is provided a prefabricated fireplace apparatus insertable as an insert into a pre-existing masonry fireplace, or usable as a fireplace or masonry heat form, in a building for heating a room. The apparatus comprises a combustion chamber defined and enclosed by heat conducting side walls, a back wall, a floor and a top. The top is provided with an opening to communicate with a flue to exhaust products of combustion in the chamber to the flue. The combustion chamber has a front access opening and doors mounted thereon to cover the opening so that when the doors are closed, air will not be admitted to the chamber through the opening. An outer wall circumscribes the combustion chamber, walls, floor and top to define therebetween an air heating chamber. The air heating chamber is provided with interior walls extending across the space between the air heating chamber walls and the outer wall to define a continuous air passageway through the air heating chamber over the major portion of the area of the walls, floor and top of the combustion chamber from the floor of the combustion chamber to its top. An outlet at the top of the air heating chamber is provided to permit passage of heated air from the air heating chamber to the room. The invention further provides an inlet at the bottom of the air heating chamber to permit entry of unheated air from the air heating chamber. The apparatus has an air manifold within the apparatus adjacent the combustion chamber. The manifold has opposite, mutually spaced walls through one of which an inlet for room air is provided and through the other of which an inlet for fresh, outside air is provided. The manifold is further provided with an outlet communicating with the air heating chamber to enable air from the manifold to pass into the air heating chamber at its bottom. A manually adjustable air flow control means is slidable between two positions, one closing the flow of air through the room air inlet and leaving open the fresh air inlet, while the other closing the flow of air through the fresh air inlet and leaving open the room air inlet. Both inlets are left open when the air flow control means is in an intermediate position. The air flow control means is of a size and construction to permit, when air enters the manifold through either of the inlets, that air to flow to the air outlet to the air heating chamber.

In a preferred embodiment the manifold is further provided with an outlet which communicates with the combustion chamber. The outlet is provided with air flow control means manually adjustable independently from the air flow control means for the manifold air inlets. The air flow control means is adjustable between open position, which permits flow of air from the manifold to the combustion chamber, and closed position, which prevents such flow.

The fireplace or fireplace insert according to the present invention provides accurate control of fresh and/or room air through the heating chamber between the walls thereof in an efficient, effective manner. While the apparatus has simple construction, it permits the user to easily manually control the makeup of the heated air supplied to the room by sliding the air flow control means of the manifold into the appropriate positioning for fresh outside air or cold room air or a combination thereof to be heated between the walls of the apparatus. As well, in the preferred embodiment thereof, in which an air outlet is provided from the manifold, communicating with the combustion chamber, multiple options of air flow destination and room/-outside air proportions directed to such destinations are effectively provided.

BRIEF DESCRIPTION OF THE DRAWINGS

These and other objects and advantages of the present invention will become apparent upon reading the following detailed description and upon referring to the drawings in which.

Figure 1:
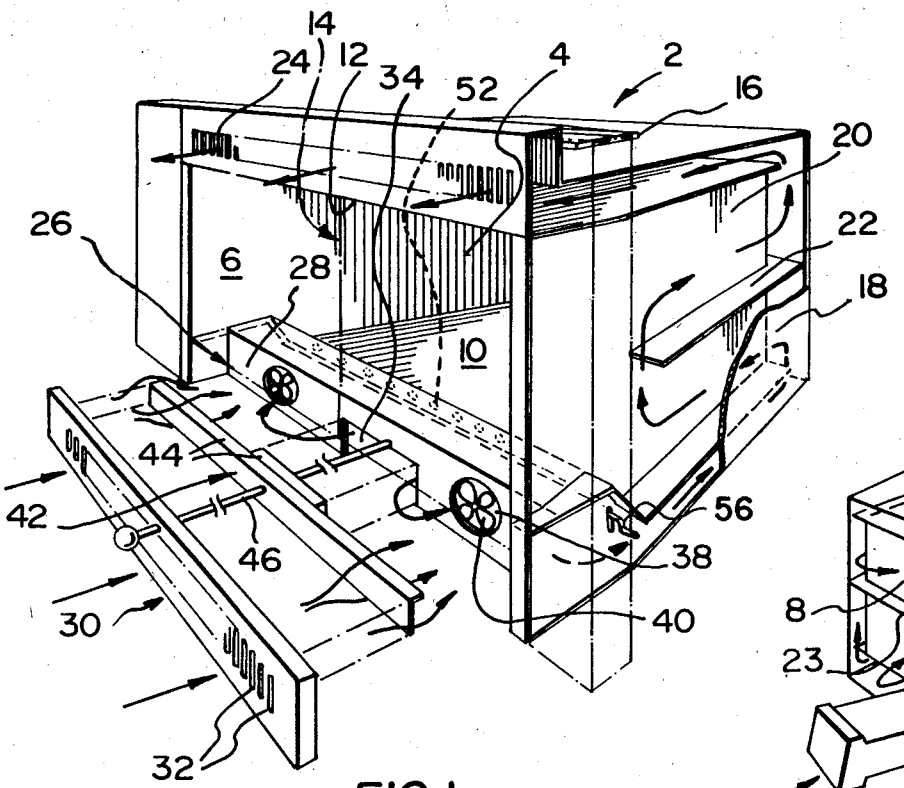
FIG. 1 is an exploded perspective view, from the front, of a fireplace insert according to the present invention.

While the invention will be described in conjunction with an example embodiment, and in particular a fireplace insert, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Turning to FIG. 1 there is shown a double walled fireplace insert 2 according to the present invention, the insert being insertable into a pre-existing masonry fireplace in a building for heating a room.

The apparatus comprises a combustion chamber 4 defined and enclosed by heat conducting side walls 6, back wall 8 (FIG. 2), a floor 10 and a top 12. The combustion chamber has a front access opening as illustrated, with doors 14 mounted on the apparatus to cover the opening so that when the doors are closed air will not be admitted to the chamber through the opening. The top is provided with an opening 16 to communicate with a flue (not shown) through which products of combustion in the combustion chamber are passed to the flue.

The apparatus is double walled, in that an outer wall 18 circumscribes side walls 6, back wall 8, floor 10 and top 12 of the combustion chamber 4, to define therebetween an air heating chamber 20. This chamber is provided with interior walls or vanes 22 which define a continuous air passageway through air heating chamber 20 over a major portion of the area of the walls 6 and 8, and floor 10 and top 12 of combustion chamber 4. This passageway extends from below the floor of the combustion chamber upwardly, in circuitous fashion as illustrated, to above its top. The vertically oriented interior walls 23, shown at the rear of the apparatus in FIG. 2, serve to divide air heating chamber 20 into two halves, with air flow upwardly progressing as illustrated therein, independently through each half. At the top of air heating chamber 22 is a vent 24 which serves as an outlet to enable passage of air heated within chamber 20, to the room. In the bottom front portion of the fireplace insert apparatus 2, at the front of combustion chamber 4 is manifold 26. This is a chamber formed in part by opposite walls 28 and 30, wall 30 being perforated to provide inlets 32 to permit passage of room air into the manifold 26. Wall 28 is provided with an inlet 34. Duct 36 communicates with inlet 34, at one end, and with a supply of fresh air, for example, from outside the building in which the fireplace insert 2 is located, at the other, to feed fresh air into manifold 26. At either side of this wall 28 are provided a pair of outlets 38 communicating with opposite halves of air heating chamber 20. Appropriately controlled fans 40 are positioned in or near outlets 38 to force air from the manifold 26 into the corresponding side of air heating chamber 20.

Figure 5:
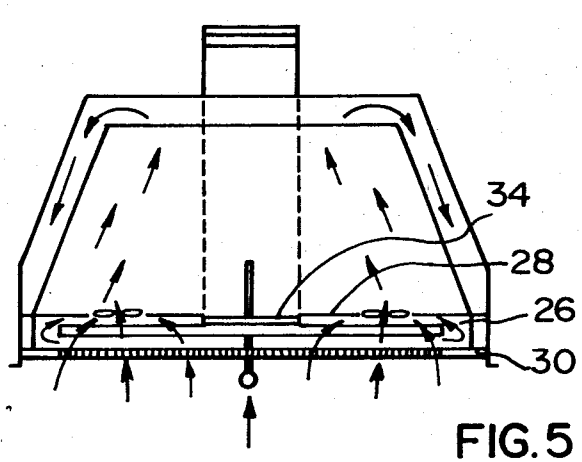
FIGS. 5 and 6 respectively are schematic top and side views of the device illustrating air flow through the double walls of the device with the air flow control means being set for supply of inside air.
Figure 6:
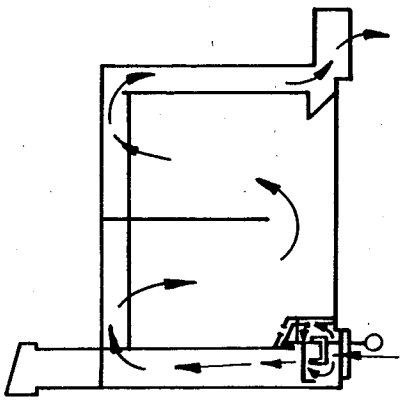
Figure 3:
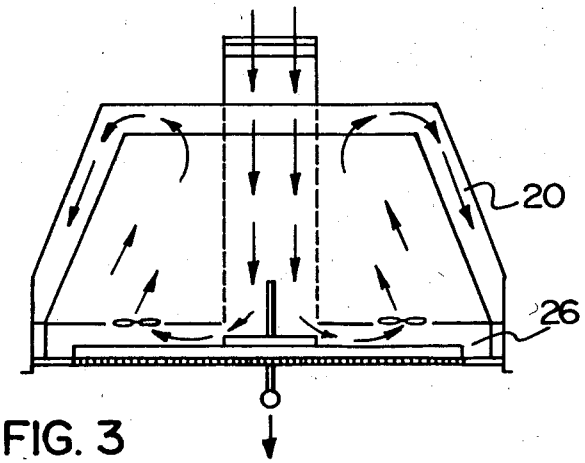
FIGS. 3 and 4 are respectively schematic top and side views illustrating air flow through the double walls of the device with the air flow control means being set for supply of fresh air.
Figure 4:
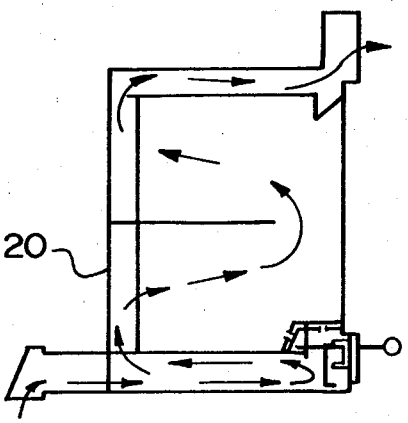
Figure 8:
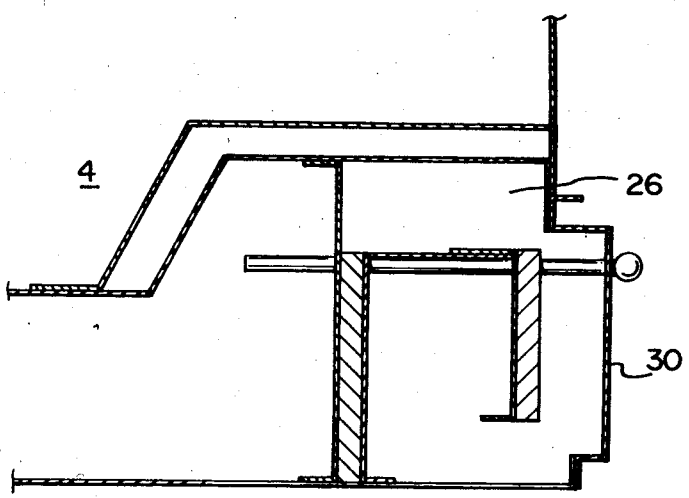
FIGS. 7 and 8 are respectively side section partial views of the manifold according to the invention illustrating in detail the air control mechanism of the embodiment of FIGS. 1 to 6.

To control the flow of air into manifold 26, there is provided an air flow control mechanism 42 which consists of panel 44, as illustrated, secured to rod 46 for slidable movement within manifold 26. As can be seen from the schematic views of FIGS. 3 and 4 and the section view of FIG. 7, when the air flow control mechanism 42 is in its outer position, with the outer panel 44 adjacent wall 30, inlets 32 are sealed off preventing room air from entering manifold 26. In this position however, fresh air inlet 34 is open so that fresh air may be drawn through duct 36 into manifold 26. As can be seen in the top and side views respectively shown in schematic FIGS. 5 and 6 and the section view of FIG. 8, when air flow control mechanism 42 is in the illustrated position with the narrower vane 44 in against wall 28 sealing inlet 34 against the flow of fresh outside air into manifold 26, the wider of the vanes 44 is spaced from wall 30 enabling room air to enter manifold 26. Of course, when the vanes or panels 44 are in an intermediate position, fresh air from duct 36 as well as room air through inlet 32 may enter manifold 26.

Figure 2:
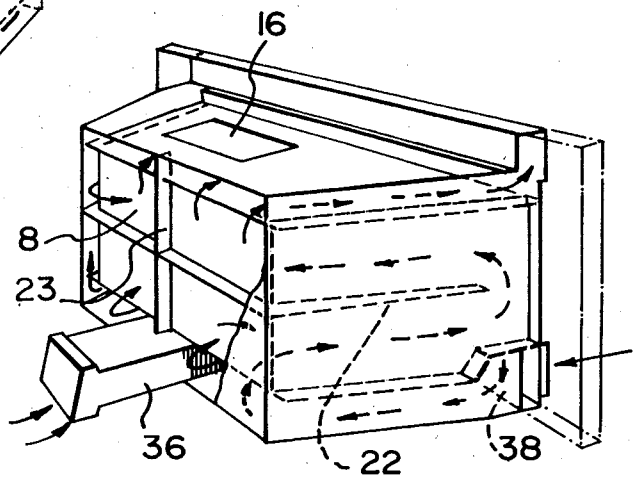
FIG. 2 is a perspective view of the device according to FIG. 1, from the rear.

It will be appreciated that cold room air or fresh outside air, entering the apparatus as it does from a low position, is forced by fan 40 into air heating chamber 20 beneath floor 10 where it proceeds to pass, as illustrated in the FIGURES, and particularly FIGS. 1 and 2, in circuitous, rising fashion, across side walls 6 and back wall 8 until it arrives at top wall 12. During combustion in combustion chamber 4, this air is gradually heated as it passes in rising fashion through air heating chamber 20 until, at the top thereof, it is passed into the room through outlets 24 as heated air.

Figure 7:
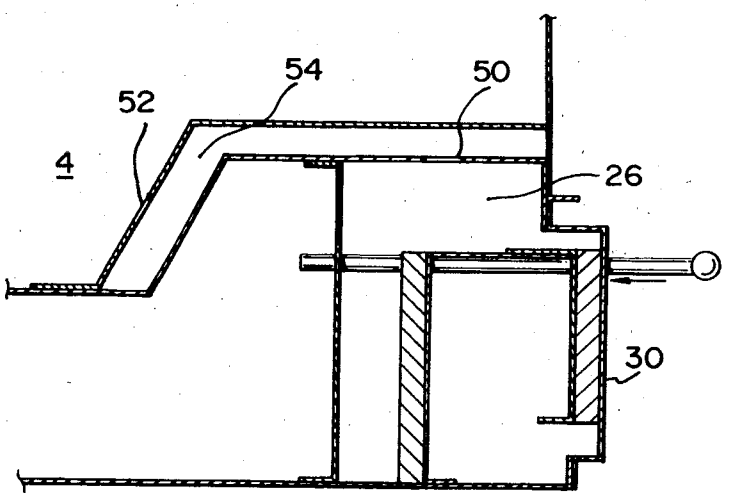

As can be seen in FIG. 7, it is preferred to have one or more outlets 50 may be provided in manifold 26, communicating directly therewith or, as illustrated, communicating with intermediate chamber 54, which in turn communicates through combustion chamber inlets 52 with the combustion chamber itself. An appropriate independently adjustable mechanism 56 (FIG. 1) is provided to enable control of the flow of air from manifold 26 to combustion chamber 4 through this intermediate chamber. This adjustment means enables complete closing off the flow of air from manifold 26 to combustion chamber 4, or, in open position, an unobstructed flow of air from the manifold to the combustion chamber. This feature, in combination with the air flow control mechanism 42 and fans 40, enables control of the source and rate of flow of air entering manifold 26, as well as control of the air in the manifold to the combustion chamber and to the air heating chamber 20.

Figure 9:
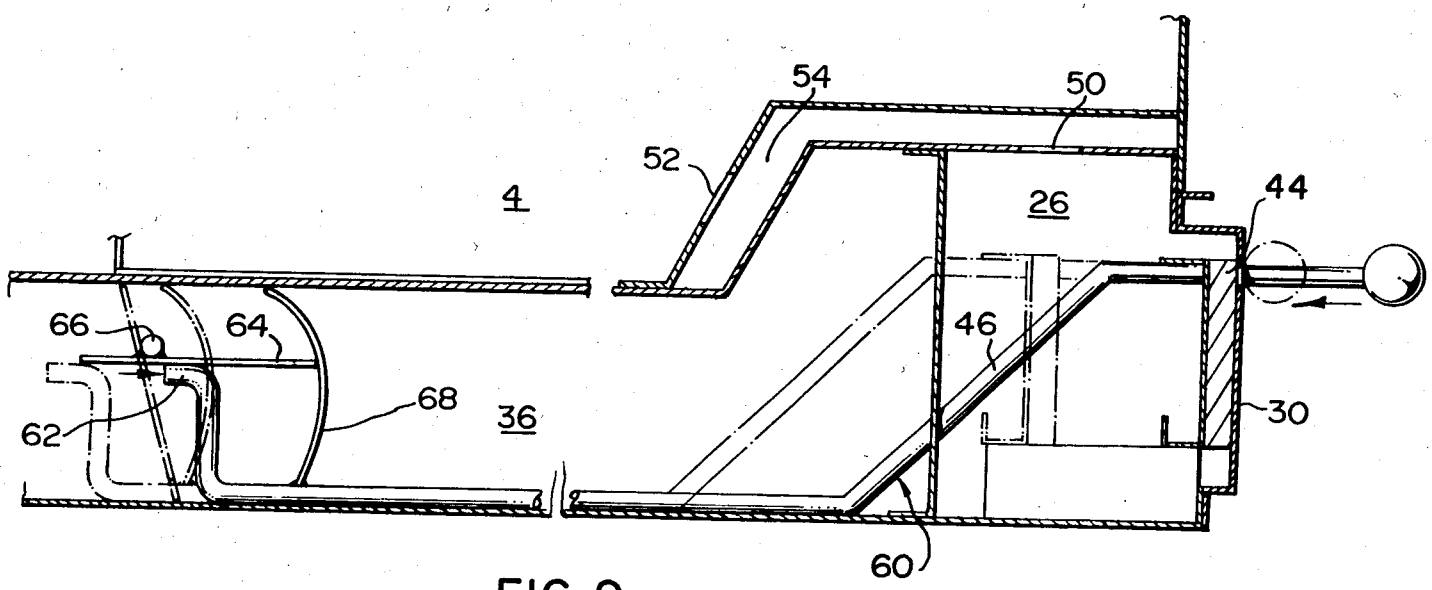
FIG. 9 is a side section partial view in detail of an alternative, preferred embodiment of air control mechanism in accordance with the invention.

Turning to FIG. 9 there is illustrated in section an alternative, preferred air control mechanism 60 according to the present invention. Rod 46 again slides within manifold 26, between one position, as shown in bold line, and another, as shown in phantom. In the first (bold line) position, panel 44 is adjacent wall 30 to close inlets 32 and thereby prevent room air from entering manifold 26. Rod 46 extends towards the rear of duct 36 near the fresh air inlet where, in this position, its upwardly extending end 62, acting as a valve control means, holds open flap 64 which, when closed as illustrated in phantom, serves as an air flow shut off valve to seal off duct 36 and prevent cold, outside air from entering. As this end 62 is moved from its other position, shown in phantom, to this first position, it bears against the flap 64 to pivot the flap at pivot point 66 from closed to open position. To close flap 64, rod 46 is moved to the left into the position illustrated in phantom. As it approaches this position, bearing surface 68 secured to the end of rod 46 bears against the forward or bottom part of flap 64 to force it downwardly. As well, this bearing surface 68 holds flap 64 in closed position when rod 46 has reached the limit of its movement to the left (phantom). At the manifold end, when rod 46 has been moved to the left, again as shown in phantom, panel 44 has been moved away from wall 30 freeing room air to enter through inlets 32 into manifold 26. Air control mechanism 60 thus differs from mechanism 42, illustrated in the preceding drawings, in that the control of fresh air from duct 36 into manifold 26 is controlled, rather than by panel 44 closing off and opening duct 36 near the manifold, by means of end 62 of rod 46 controlling the opening and closing of flap 64. The advantage of mechanism 60 is that fresh air is shut off closer to the source, thereby reducing cold air transfer when the apparatus is not in operation.

As previously indicated, the apparatus of the present invention has application not only as a fireplace insert, but also as a factory built zero clearance fireplace or a masonary fireplace heat form.

Thus it is apparent that there has been provided in accordance with the invention an improved double walled pre-fabricated fireplace apparatus that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention:

1. In a prefabricated fireplace apparatus for heating a room, comprising a combustion chamber defined and enclosed by heat conducting side walls, a back wall, a floor and a top, the top having an opening to communicate with a flue to exhaust products of combustion in the chamber, the combustion chamber having a front access opening and doors mounted thereon to cover the opening so that when the doors are closed air will not be admitted to the chamber through the opening; an outer wall circumsribing the combustion chamber walls, floor and top to define therebetween an air heating chamber; the air heating chamber being provided with interior walls extending between the air heating chamber walls to define a continuous air passageway through the air heating chamber over the major portion of the area of the walls, floor and top of the combustion chamber from the floor of the combustion chamber to its top; an outlet at the top of the air heating chamber to permit passage of heated air from the air heating chamber to the room; and an inlet at the bottom of the air heating chamber to permit entry of unheated air to the air heating chamber; the improvement comprising an enclosed air manifold mounted adjacent the combustion chamber and having opposite, mutually spaced walls, a first of said walls including an inlet for room air and a second of said walls including an inlet for outside air, the manifold being further provided with an outlet means operative to enable air from the manifold to pass into the air heating chamber at its bottom, manually adjustable air flow control means being slidable through an intermediate position between a first position wherein said control means closes the flow of air through the room air inlet while leaving open the flow of air through the outside air inlet, and a second position wherein said control means closes the flow of air through the outside air inlet while leaving open the flow of air through the room air inlet, the flow of air simultaneously through both the room air inlet and the outside air inlet being permitted when the air flow control means is in the intermediate position, said air flow control means being of a size and construction so that when air enters the manifold through either or both of the outside and room air inlets, such air will be permitted to flow through the outlet means and to the air heating chamber.

2. An apparatus according to claim 1 wherein the manifold outlet means communicates with the combustion chamber, the outlet means being provided with outlet control means manually adjustable independently from the air flow control means for the manifold room and outside air inlets between an open position permitting flow of air from the manifold to the combustion chamber and a closed position preventing such flow.

3. An apparatus according to claim 1 or 2 wherein the air flow control means for the manifold comprises a panel structure slidable between one position closing the flow of air through the room air inlet to air flow into the manifold while at the same time opening the fresh air inlet to air flow into the manifold, and the other position closing the fresh air inlet to the flow of air while at the same time opening the room air inlet to the flow of air.

4. An apparatus according to claim 2 wherein the outlet means communicates with said air heating chamber and a fan means is provided at or near the outlet means to draw air from the manifold into the air heating chamber.

5. An apparatus according to claim 4 wherein said outlet means includes an outlet communicating with the air heating chamber provided at each side of the manifold, a fan being provided at or near each said outlet to direct the flow of air from the manifold into the air heating chamber through each outlet, interior walls of the air heating chamber dividing the air heating chamber into two parts, one on each side of the apparatus, having similar continuous air passageways.

6. An apparatus according to claim 4 wherein said outlet means includes a separate enclosed chamber communicating with said manifold to receive air therefrom, said separate chamber including an outlet to said combustion chamber and at least one outlet to said air heating chamber.

7. An apparatus according to claim 6 wherein an outside air passageway is provided within the apparatus, the passageway at one end communicating with the outside air inlet of the manifold and communicating at its other end with a source of fresh air outside of the room.

8. An apparatus according to claim 7 wherein the outside air passageway is provided with an air flow shut off valve near its end communicating with the source of fresh air outside the room, and wherein the air flow control means panel structure is linked to a shut off valve control means for simultaneous movement, the panel structure and valve control means being simultaneously movable between one position in which the panel structure closes the flow of air through the room air inlet while the shut off valve control means holds the air shut off valve open, and another position in which the panel structure permits the flow of air through the room air inlet while the shut off valve control means holds the air shut off valve closed to prevent flow of air through the fresh air duct.

9. An apparatus according to claim 2 wherein the air manifold is positioned within the apparatus in front of the combustion chamber.

10. An apparatus according to claim 2 wherein the manifold is elongated from side-to-side, extending substantially across the front of the combustion chamber at its floor between the side walls thereof.

11. An apparatus according to claim 10 wherein the air flow control means for the manifold air inlets comprises an elongated panel structure extending substantially across the extent of the manifold, from side-to-side, and slidable within the manifold between first and second positions.

12. An apparatus according to claim 11 wherein the movement of the air flow control means for the manifold air inlets is controlled by a single lever secured thereto and projecting outwardly from the front of the apparatus.

13. An apparatus according to claim 2 wherein a single lever is secured to the control means for the combustion chamber outlet control means to permit manual adjustment thereof, said lever projecting outwardly from the apparatus.

14. An apparatus according to claim 1 wherein the manifold is elongated from side-to-side, extending substantially across the front of the combustion chamber at its floor between the side walls thereof.

15. An apparatus according to claim 14 wherein the air flow control means for the manifold air inlets comprises an elongated panel structure extending substantially across the extent of the manifold, from side-to-side, and slidable within the manifold between first and second positions, said panel structure being also adapted to be positioned at an intermediate position between said first and second positions.

16. An apparatus according to claim 15 wherein an outside air passageway is provided within the apparatus, the passageway at one end communicating with the outside air inlet of the manifold, and communicating at its other end with a source of fresh air outside of the room.

17. An apparatus according to claim 16 wherein the passageway for the outside air is a duct for outside air passing through the air heating chamber under the floor of the combustion chamber.

18. An apparatus according to claim 16 wherein the outside air passageway is provided with an air flow shut off valve near its end communicating with the source of fresh air outside the room, and wherein the air flow control means panel structure is linked to a shut off valve control means for simultaneous movement, the panel structure and valve control means being simultaneously movable between one position in which the panel structure closes the flow of air through the room air inlet while the shut off valve control means holds the air shut off valve open, and another position in which the panel structure permits the flow of air through the room air inlet while the shut off valve control means holds the air shut off valve closed to prevent flow of air through the fresh air duct.

19. An apparatus according to claim 15 wherein the movement of the air flow control means for the manifold air inlets is controlled by a single lever secured thereto and projecting outwardly from the front of the apparatus.

* * * * *